United States Patent [19]

Reed

[11] Patent Number: 4,984,622

[45] Date of Patent: Jan. 15, 1991

[54] APPARATUS FOR SUPPLYING TEMPERATURE REGULATED AIR TO A CALENDER ROLL

[75] Inventor: Gordon K. Reed, Bexley, Ohio

[73] Assignee: Process Automation Business, Inc., Columbus, Ohio

[21] Appl. No.: 415,947

[22] Filed: Oct. 2, 1989

[51] Int. Cl.[5] ..... F24H 3/04; B30B 15/34; B30B 15/04

[52] U.S. Cl. ..... 165/47; 165/163; 165/156; 100/93 RP; 392/347; 392/475; 392/492

[58] Field of Search ..... 165/47, 156, 163; 219/374, 375, 376, 381, 382, 306, 307; 100/93 RP

[56] References Cited

U.S. PATENT DOCUMENTS

| | | | |
|---|---|---|---|
| 604,384 | 5/1898 | Gold | 219/375 |
| 926,185 | 6/1909 | Hayes | 219/306 |
| 1,383,033 | 6/1921 | Seimbille | 219/307 |
| 1,439,340 | 12/1922 | Clair, Jr. | 219/381 |
| 1,770,208 | 7/1930 | Kemnal . | |
| 1,776,135 | 9/1930 | Smith | 165/156 |
| 1,893,484 | 1/1933 | Belt | 165/156 |
| 2,061,742 | 11/1936 | Swart | 165/163 |
| 3,306,352 | 2/1967 | Curren | 165/163 |
| 4,009,751 | 3/1977 | Zelnik | 165/156 |
| 4,559,998 | 12/1985 | Counterman | 165/109.1 |
| 4,685,389 | 8/1987 | Boissevain | 100/93 RP |
| 4,738,196 | 4/1988 | Boissevain | 100/93 RP |
| 4,748,906 | 6/1988 | Ashmore | 100/93 RP |
| 4,768,433 | 9/1988 | Boissevain | 100/93 RP |

FOREIGN PATENT DOCUMENTS

| | | | |
|---|---|---|---|
| 78022 | 11/1894 | Fed. Rep. of Germany | 165/156 |
| 1086626 | 10/1967 | United Kingdom | 219/307 |

OTHER PUBLICATIONS

Brochure: "MIRCOSET TM Actuator Family—MIRCOSET Thermo-Profiler", AccuRay Corporatoin, 1987.

*Primary Examiner*—John Ford

*Attorney, Agent, or Firm*—John H. Mulholland; William W. Habelt

[57] ABSTRACT

An apparatus 10 is provided for supplying a high-velocity flow of temperature regulated air 5 to the calender roll 90 of a paper making machine. Ambient air 1 is received into the plenum chamber 20 and distributed therefrom through a longitudinally elongated conduit means 30 which has an inlet 32 opening directly into the plenum chamber 20 and an outlet opening 36 along the other end thereof and defining therebetween a flow passageway 34. The outlet opening 36 is adapted to direct the air flow passing through the flow passageway 34 along the calender roll 90 in counter direction to the rotation of the calender roll 90. A series of spiral wound heating element coils 40 are disposed within the conduit means 30 at longitudinally spaced intervals along the length thereof to heat the air to a desired temperature by selectively powering the heating element coils 40. A flow turbulator 50 is disposed within the center of each spiral wound heating coil 40 in the flow path therethrough whereby the air passing therethrough is directed into contact with the coils of the spiral wound heating coil 40 thereby increasing the efficiency of heat transfer from the heated coils to the air.

6 Claims, 1 Drawing Sheet

APPARATUS FOR SUPPLYING TEMPERATURE REGULATED AIR TO A CALENDER ROLL

The present invention relates generally to an apparatus for heating a flow of gaseous fluid and, more particularly, an apparatus for heating a flow of air for contacting against the calender roll of a paper making machine so as to heat or cool the calender roll.

In the making of certain types of paper, for example newsprint, fine paper, and printing and writing grade papers, uniformity of the caliper of the paper is essential to yield a quality product. The elimination of cross-machine variations in caliper would result in improved paper quality and sheet finish, fewer rejects and increased efficiency in subsequent downstream processing.

A conventional method of controlling caliper by eliminating variations in the cross-machine caliper profile is heating or cooling the calender roll to change the nip load by selectively directing a high-velocity, low-volume flow of temperature regulated air along the calender roll in counter-direction to the rotation of the calender roll. This air flow effectively pierces the boundary layer created by rotation of the roll.

One particularly suitable apparatus for carrying out this method of reducing variations in the cross-machine caliper profile is the MICROSET Thermo-Profiler TM actuator manufactured by Process Automation Business, Inc. of Columbus, Ohio. This apparatus comprises a plenum chamber which extends axially along the length of the calender roll in juxtaposed relationship to the calender roll, conduit means extending longitudinally outward from the plenum chamber defining a flow passageway through which the low volume air flow passes to and thence through a nozzle at the outlet end of the conduit, and a series of heating element coils disposed at longitudinally spaced intervals within the conduit means. As the air flow passes from the plenum chamber through the conduit means, a portion passes through the center of each heating element coil before it passes from the conduit means through the nozzle along the calender roll in counter-direction to the rotation of the calender roll.

The heating elements are electrically powered, spiral wound heating coils which are selectively activated to heat the air flow passing through the conduits to regulate the temperature of the calender roll and ultimately the thickness of the paper. As the temperature of the air flow directed against the calender roll is increased, the temperature of the calender roll is increased thereby increasing the nip load and decreasing the paper thickness. Utilizing ambient air with the heating coils deactivated results in a cooling of the calender roll thereby decreasing the nip load and increasing the paper thickness.

Although the aforedescribed apparatus has proven very effective in reducing cross-machine caliper variations, the temperature of the air flow passing therethrough is limited by each heating coil's maximum sheath temperature. To further increase the power supplied to the heating coils to increase the air temperature would reduce the life expectancy of the coils.

As the air flow passes through the center of the coils through the open flow path defined within the center of each spiral wound coil, the air does not effectively contact the heating coils thereby resulting in inefficient heat transfer from the heating coils to the high-velocity air flow. One attempt to increase the efficiency of heat transfer, thereby increasing the achievable air temperature for a given sheath temperature, has been to mount half discs to the interior of the heating coil at spaced intervals along the length of the center of the heating coil with alternate discs extending into the center of the coil from opposite directions. Unfortunately, this solution causes an increase in pressure drop through the coil and also creates areas a "dead air" space in the immediate vicinity of the discs.

Accordingly, it is an object of the present invention to provide an improved apparatus of the type hereinbefore described capable of developing higher temperature air without exceeding sheath temperature limits, while minimizing any increased pressure drop and avoiding the creation of dead air pockets.

SUMMARY OF THE INVENTION

In accordance with the present invention, a flow turbulator is disposed within the center of each spiral wound heating coil in the flow path through the center of the spiral wound heating coil whereby the air passing therethrough is directed into contact with the spiral wound heating coil.

Most advantageously, the flow turbulator comprises a thin spiral-twisted ribbon-like strip having a width less than the inner diameter of the spiral wound heating coil. For best results, the spiral-twisted ribbon-like strip is twisted counter to the wind of the spiral-wound heating coil.

BRIEF DESCRIPTION OF THE DRAWINGS

A better understanding of the invention may be had with reference to the following detailed description of the preferred embodiment shown in the accompanying drawing, wherein.

DESCRIPTION OF THE PREFERRED EMBODIMENT

Figure 1:
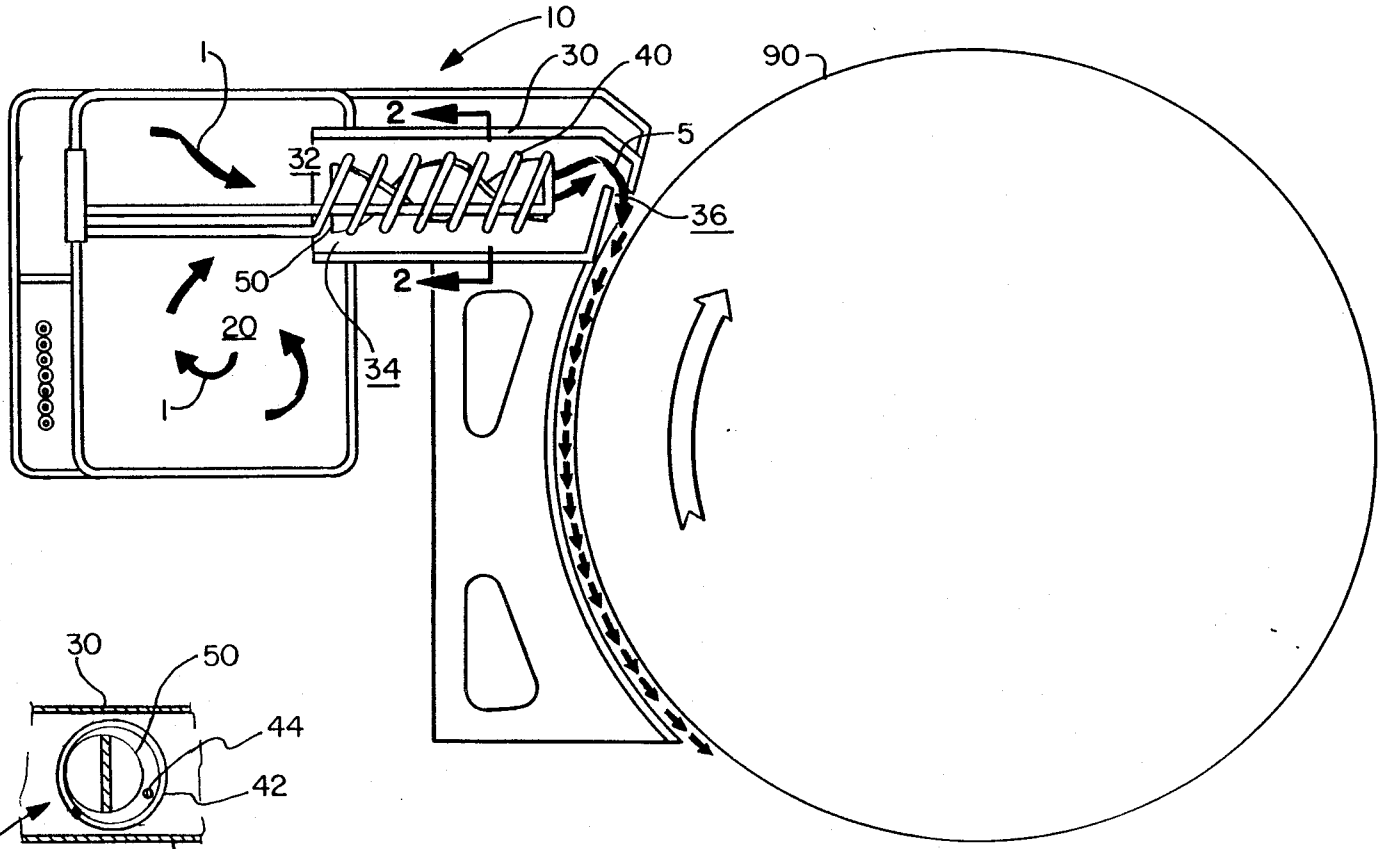
FIG. 1 is a side elevational view, partly in section, illustrating the apparatus of the present invention applied to a calender roll of a paper making machine.
Figure 2:
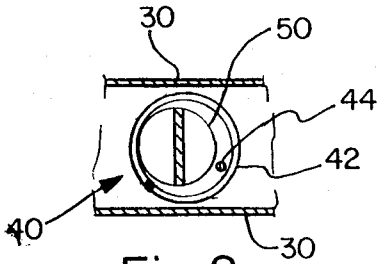
FIG. 2 is a cross-sectional view taken along line 2—2 of FIG. 1.

Referring now to the drawing, there is depicted therein an apparatus 10 for supplying a high-velocity flow of temperature regulated air 5 to the calender roll 90 of a paper making machine. Ambient air 1 is received into the plenum chamber 20 of the apparatus 10 are distributed therefrom through a longitudinally elongated conduit means 30 which extends, with the plenum chamber 20, along the length of the calender roll 90. The conduit means 30 has an inlet 32 extending along one end thereof opening directly into the plenum chamber 20 and an outlet opening 36 along the other end thereof and defining therebetween a flow passageway 34. The outlet opening 36 is adapted to direct the air flow passing through the flow passageway 34 along the calender roll 90 in counter direction to the rotation of the calender roll 90.

In order to provide for the selective heating of the ambient air 1 to generate the desired flow of temperature regulated air 5, a series of spiral wound heating element coils 40 are disposed within the conduit means 30 at longitudinally spaced intervals along the length thereof. As the ambient air 1 passes from the plenum chamber 20, a portion thereof passes through the center of each heating element 40 and is thereby heated to a desired temperature by selectively powering the heating element coils 40.

In accordance with the present invention, a flow turbulator 50 is disposed within the center of each spiral wound heating coil 40 in the flow path therethrough whereby the air passing therethrough is directed into contact with the coils of the spiral wound heating coil 40 thereby increasing the efficiency of heat transfer from the heated coils to the air.

Most advantageously, the flow turbulator 50 comprises a thin, spiral-twisted ribbon-like strip having a width slightly less than the inner diameter of the individual spiral wound heating coils 42 less the width occupied by the return run 44 of the heating element 40. Typically, the turbulator 50 is formed of a metallic strip having a thickness of approximately thirty-one thousandths of an inch and a width of one and one-quarter inch.

Additionally, heat transfer is enhanced more efficiently when the spiral-twisted ribbon-like strip 50 forming the turbulator is twisted counter to the wind of the spiral-wound heating element coil 40 in which it is disposed. When a heating coil 40 has a right-hand spiral wind, the spiral-twisted, ribbon-like strip 50 is given a left-hand twist. Conversely, when a heating element coil 40 has a left-hand spiral wind, the spiral-twisted, ribbon-like strip 50 is given a right-hand twist.

Accordingly, there has been provided in accordance with the present invention an improved apparatus 10 for use in supplying temperature regulated air to a calender roll wherein higher air temperatures may be produced at a given power input to the heating element without exceeding element sheath temperature limits. By inclusion of the flow turbulator 50 within the center cavity of the spiral-wound heating element coil 40 in accordance with the present invention, the efficiency of heat transfer from the heater coils 42 to air passing through the conduit means 30 is increased without the penalty of increased pressure drop or the creation of dead air space as experienced in the prior art as hereinbefore noted. The apparatus of the present invention not only permits greater air temperature rises to be achieved without utilizing higher power levels, but also permits reduced volume of air flow over the coils 42 at the upper range of power inputs without exceeding maximum sheath temperature.

It is to be understood that the specific embodiment of the apparatus depicted in the drawing and described herein with respect to its application for supplying a high-velocity, low-volume, temperature regulated air flow to the calender roll of a paper making machine as a means of controlling paper thickness, is merely illustrative of a preferred embodiment in its most advantageous application presently contemplated. It is intended that any modifications of the apparatus of the present invention for use in producing temperature regulated gaseous fluid flow which is apparent to those skilled in the art in light of the foregoing description and which falls within the spirit and scope of the appended claims be included in the invention recited therein.

I claim:

1. Apparatus for supplying temperature regulated air to a calender roll of a paper making machine so as to heat or cool the calender roll, comprising:

a. a plenum chamber for receiving ambient air to be selectively heated to a desired temperature;

b. conduit means extending longitudinally along the calender roll, said conduit means having an inlet at one end thereof opening to said plenum chamber and an outlet at the other end thereof and defining therebetween a flow passageway traversed by the air passing from said plenum chamber to the outlet, the outlet adapted to direct the air against the calender roll;

c. a plurality of helical wound heating element coils disposed in longitudinally spaced relationship within the flow passageway of said conduit means, each heating element coil having an open central cavity defining a flow path therethrough and wound in a first direction; and d. a flow turbulator disposed within the central cavity of each of said heating element coil in the flow path therethrough whereby the air passing through the central cavity is directed into contact with said heating element coil, each of said flow turbulators comprising a thin spiral-twisted ribbon-like strip having a width less than the inner diameter of said heat transfer coil means and twisted in a second direction counter to the first direction in which the heating coil in which it is disposed is wound.

2. An apparatus as recited in claim 1 wherein said heat transfer coil means comprises a helical coil wound in a right-hand twist and said flow turbulator comprises a thin spiral-twisted ribbon-like strip having a left-hand twist.

3. An apparatus as recited in claim 1 wherein said heat transfer coil means comprises a helical coil wound in a left-hand twist and said flow turbulator comprises a thin spiral-twisted ribbon-like strip having a right-hand twist.

4. Apparatus for heating or cooling fluid comprising:

a. a plenum chamber for receiving the gaseous fluid;

b. longitudinally extending conduit means having an inlet at one end thereof opening to said plenum chamber and an outlet at the other end thereof and defining therebetween a flow passageway;

c. helical wound heat transfer coil means for selectively heating or cooling, said heat transfer coil means disposed longitudinally within the flow passageway of said conduit means and having a flow path through the center thereof and wound in a first direction; and d. a flow turbulator disposed within the center of said heat transfer coil means in the flow path therethrough whereby the gaseous fluid passing through the flow therethrough is directed into contact with said heat transfer coil means, said flow turbulator comprising a thin spiral-twisted ribbon-like strip having a width less than the inner diameter of said heat transfer coil means and twisted in a second direction counter to the first direction in which said heating coil is wound.

5. An apparatus as recited in claim 4 wherein said heat transfer coil means comprises a helical spiral wound in a right-hand twist and said flow turbulator comprises a thin spiraltwisted ribbon-like strip having a left-hand twist.

6. An apparatus as recited in claim 4 wherein said heat transfer coil means comprises a helical spiral wound in a left-hand twist and said flow turbulator comprises a thin spiral-twisted ribbon-like strip having a right-hand twist.

* * * * *